United States Patent [19]

Okada et al.

[11] Patent Number: 4,526,848

[45] Date of Patent: Jul. 2, 1985

[54] ELECTROPHOTOGRAPHIC PROCESS WITH A.C. CHARGER PRODUCING GREATER POSITIVE CHARGE

[75] Inventors: Takao Okada; Akitoshi Toda; Yoshiyuki Mimura, all of Hachioji, Japan

[73] Assignee: Olympus Optical Company Ltd., Tokyo, Japan

[21] Appl. No.: 549,069

[22] Filed: Nov. 7, 1983

[30] Foreign Application Priority Data

Nov. 27, 1982 [JP] Japan ..... 57-208313

[51] Int. Cl.[3] ..... G03G 13/052; G03G 13/24

[52] U.S. Cl. ..... 430/55; 430/902; 361/229

[58] Field of Search ..... 430/55, 902; 361/229

[56] References Cited

U.S. PATENT DOCUMENTS 3,760,229 9/1973 Silverberg ..... 361/229 X
3,775,104 11/1973 Matsumoto et al. ..... 430/902 X

FOREIGN PATENT DOCUMENTS 42-23910 11/1967 Japan .
47-26911 7/1972 Japan .
49-4658 2/1974 Japan ..... 430/55
54-36498 11/1979 Japan .

*Primary Examiner*—Roland E. Martin
*Attorney, Agent, or Firm*—Louis Weinstein

[57] ABSTRACT

An electrophotographic process employs an electrophotographic photosensitive member of a basic construction in which a photoconductive layer and a transparent insulator layer are sequentially laminated on the surface of a conductive supporter. The process in one preferred embodiment comprises a first step of providing a primary charge uniformly from the surface side of the transparent insulator layer, a second step of performing a secondary corona charging during an imagewise exposure by applying an a.c. voltage in which the firing angle of a negative half wave is controlled in phase to be within a phase angle corresponding to a lower voltage than the firing angle so that the positive discharge period may be longer than the negative one during one period, and a third step of forming an electrostatic latent image on the transparent insulator layer by applying a uniform exposure.

6 Claims, 8 Drawing Figures

FIG. 1 (II)

FIG. 1 (III)

FIG. 4 (II)

FIG. 4 (III)

ELECTROPHOTOGRAPHIC PROCESS WITH A.C. CHARGER PRODUCING GREATER POSITIVE CHARGE

BACKGROUND OF THE INVENTION

The present invention relates to an electrophotographic process, and more particularly, to such a process for forming an electrostatic latent image of a high contrast voltage on an electrophotographic photosensitive member.

As is well recognized, an electrophotographic photosensitive member has a basic construction in which a conductive supporter, a photoconductive layer and a transparent insulator layer are sequentially laminated. By way of example, in an electrophotographic process which forms an electrostatic latent image on the photosensitive member, it has been known to employ a process in which after a primary charging, a secondary corona charge is applied by a sinusoidal wave a.c. corona discharging during an imagewise exposure and subsequently an electrostatic latent image is formed by a uniform exposure (Japanese Patent Publication No. Sho 42-23910).

However, the conventional electrophotographic process employs a conventional sinusoidal wave a.c. corona discharging method to provide a secondary corona charge and hence it has a disadvantage in that even if a positive and a negative voltage-time integration value of a sinusoidal wave alternate current applied to a corona charger are identical, the charging inclines toward the negative side because the corona discharging method has the characteristics of a negative corona discharging being more liable to occur than a positive one. Accordingly, for example, when the photosensitive member is a photoconductive layer of the p-type, with the electrophotographic process, a primary charge is provided with negative charge, a secondary charging is applied with a sinusoidal a.c. corona charging method during an imagewise exposure and then a uniform exposure is provided to form an electrostatic latent image. As a result of this process, it is difficult to sufficiently neutralize and remove the negative charge at a bright area of an image and to render the contrast voltage between the bright and dark areas of the image sufficiently high. At this time, a potential level at the bright area indicates a negative value (−100 to −600 V) and when the latent image is developed with a positive charge toner a photographic fog is disadvantageously produced.

SUMMARY OF THE INVENTION

In view of the foregoing, it is an object of the invention to provide an electrophotographic process in which the secondary corona charging is provided with an a.c. voltage in which a firing angle for its negative half wave is controlled in phase to be within the scope of a phase angle corresponding to a higher voltage than the firing potential so that the positive discharging period becomes longer than the negative one during one period.

According to the invention, it is possible to properly adjust the ratio between the positive and negative discharging periods by controlling a firing angle for a negative half wave in phase, thereby the ratio between the amounts of discharged positive and negative corona ions is adjusted. Accordingly, it is possible to improve the characteristics in that the discharging is liable to incline toward the negative side in the prior art and to emphasize that the charge has the positive polarity. Specifically, with the secondary corona discharging it is possible to change a surface potential of the photosensitive member at the bright area to a potential of a polarity reverse to a primary charge at zero V or its neighborhood of the surface potential. Thereby, it is possible to establish desired potential levels at the bright and dark areas of the latent image and to obtain the latent image with a high contrast so that there may be less possibility of causing a photographic fog.

In addition, an adjustment of a frequency in accordance with a speed of charging and/or exposure process will result in the formation of the latent image of less influence of the frequency response.

DESCRIPTION OF THE PREFERRED EMBODIMENTS

Figure 1:
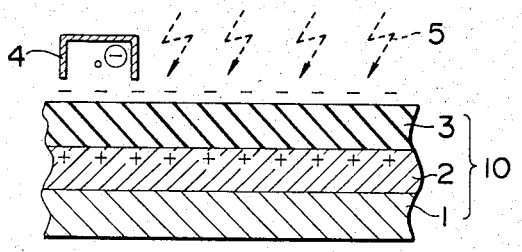
FIGS. 1 (I) to (III) are process charts showing respective sequential steps in an electrophotographic process of an embodiment according to the invention.
Figure 1:
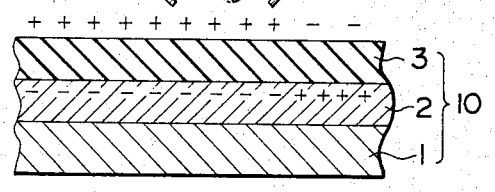
Figure 1:
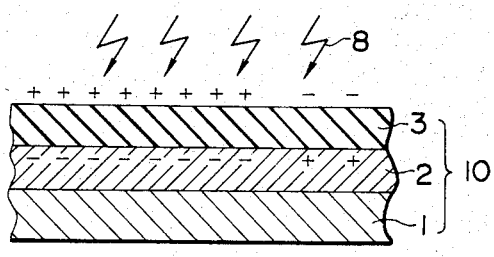

Referring to FIGS. 1 (I) to (III), an electrophotographic photosensitive member 10 to which an electrophotographic process of an embodiment of the invention is applied has a basic construction in which a photoconductive layer 2 and a transparent insulator layer 3 are sequentially laminated on the surface of a conductive supporter 1. The conductive supporter 1 is formed of a conductive material such as Al, Ag, Cu, Au, Ni, Cr or the like, for example, or may be a composite body such as a conductive layer coated on the surface of a nonconductive substrate. The photoconductive layer 2 is formed of an inorganic photoconductive material such as Se, Se-Te, Se-Te-As, Se-As, Si, amorphous Si, CdS, ZnO, PbO or the like or an organic photoconductive material such as Polyvinyl carbazole PVK, Trinitrofluorenone TNF or the like. The transparent insulator layer 3 is formed of a coating of Polyethylene trephthalate, Teflon, Polypropylene, Polyvinyl fluoride, Polyamide, Polyester or the like or a gaseous phase evaporation or application and drying of a copolymerized resin of Vinylchloride and Vinylacetate, a thermoplastic resin such as Methacrylic resin, Polyvinyl butyral resin, Polystyrene resin, Vinylidene chloride resin, a thermosetting resin such as Epoxy resin, Alkyd resin, Polyester resin, Phenol resin, Urea resin, Melamine resin, Acrylic resin, Urethane resin, Silicone resin.

In the first step of the electrophotographic process, which is a primary charging process, of the embodiment in the case that the photoconductive layer 2 is of the p-type, uniform negative charge is provided on the insulator layer 3 by applying a high negative d.c. voltage to a corona charger 4, as shown in FIG. 1 (I). Thereupon, pairs of positive and negative charge are uniformly formed on opposite sides of the insulator layer 3. At the time of the primary charging, there may be a case that charge is not sufficiently injected from the side of conductive supporter 1 to the photoconductive layer 2 depending upon the kind of material of the photoconductive layer 2 and the conductive supporter 1. In this case, the primary charging may be effectively achieved by applying a uniform exposure of light 5 during the corona charging or thereafter as is shown by dotted lines in FIG. 1 (I).

Figure 2:
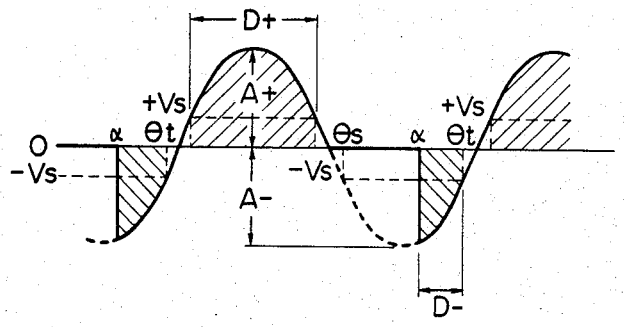
FIG. 2 is a wave form diagram of a voltage employed in the second step shown in FIG. 1 (II)

In the second step of the electrophotographic process which is a step of a secondary corona charging in concurrence with an imagewise exposure, of the embodiment in the case that the polarity of the primary charge is negative, as shown in FIG. 1 (II), a corona discharging is provided with a high voltage having a wave form as shown in FIG. 2 which is applied to a corona charger 6 in concurrence with an exposure of a light image 7. The high voltage has a wave form that a negative half wave of its sinusoidal wave a.c. voltage is controlled in phase with the firing angle $\alpha$ (for a thyristor, as will be described later), which is selected to be within the scope of $\theta s-\theta t$ ($\theta s$, $\theta t$: phase angles corresponding to the firing start and termination potentials) of a phase angle corresponding to a lower voltage than the negative firing potential $-Vs$. It will be understood that a positive and a negative amplitude $A+$, $A-$ (absolute value) of the sinusoidal wave a.c. voltage are set to be larger than the firing potential Vs (the degree of 4 kV) of the corona charger 6. Since the firing angle $\alpha$ is within the scope of $\theta s-\theta t$, the positive discharge period $D+$ is longer than the negative one $D-$ during one period and more positive corona ions are ejected than are negative ones. In FIG. 2, however, it is assumed for simplification of the explanation that the firing start potential and the firing termination potential of the corona charger 6 are substantially equal and their values are Vs (absolute value).

At the bright area of light image 7 where light is irradiated, surface charge of the insulator layer 3 is eliminated by the secondary corona charging in concurrence with the imagewise exposure and carriers are generated within the photoconductive layer 2 by the light. Accordingly, after the primary charging, the positive charge on the lower side of the insulator layer 3 is neutralized and released. Additionally, since the positive area of the secondary corona charging voltage is set so as to be larger than the negative one to some degree in the process of the invention, the surface of the insulator layer 3 is positively charged to the neighborhood of zero V reversely to the primary corona charge, in this case not limited to the charge neutralization. At this time, since light is irradiated, pairs of positive and negative charge are formed with the insulator layer 3 between in a manner similar to the primary charging. At the dark area of the light image 7 where light is not irradiated, the positive charge on the photoconductive layer 2 at the insulator layer 3 side is retained without being neutralized and released.

In the third step, which is a step of a uniform exposure, as shown in FIG. 1 (III), a uniform irradiation of light 8 is applied from the side of insulator layer 3. When the uniform irradiation of light 8 is applied, at the dark area of the light image, other charge than a first charge on the surface of insulator layer 3 and a second charge on the photoconductive layer at the side of insulator layer 3 corresponding to the first one is extinguished. At the bright area of the light image, no movement of charge occurs. As a result, an electrostatic latent image whose bright area is positive and whose dark area is negative is formed on the surface of the insulator layer 3.

As described above, in the electrophotographic process of the embodiment, the secondary corona charging is provided employing an a.c. voltage which is controlled in phase so that the firing angle $\alpha$ of the negative half wave is within the scope of the phase angle $\theta s-\theta t$ corresponding to a lower voltage than the firing potential $-Vs$. Accordingly, positive corona ions are ejected in a larger amount as compared with the prior art and an electrostatic latent image of a high contrast voltage which is emphasized that charge has the positive polarity can be formed.

A frequency range of 50 to 1,000 Hz is most suitable for the secondary corona discharging voltage and is selected in accordance with a speed of charging and/or exposure process. For example, when a high value in the range of frequency is selected, the process speed may be increased.

Figure 3:
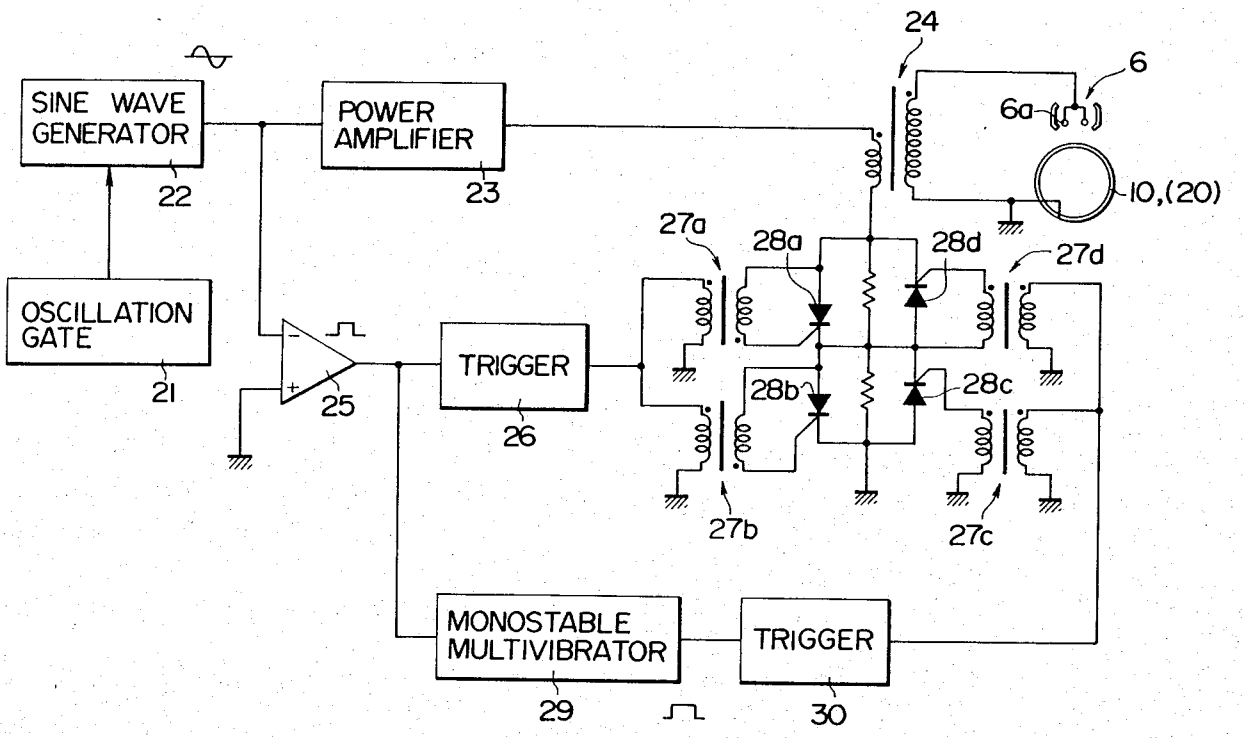
FIG. 3 is an electric circuit diagram showing an example of a high voltage a.c. source apparatus for a phase control to generate the voltage shown in FIG. 2.

By way of example, the corona charger 6 may be connected to a high voltage a.c. source apparatus for a phase control as shown in FIG. 3. The a.c. source apparatus itself is already well known and generates a sinusoidal wave from a sine wave generator 22 while signals are given from an oscillation gate 21. The sinusoidal wave is applied through a power amplifier 23 to one terminal of a primary coil of a wide band pulse transformer 24. In addition, the sinusoidal wave is applied to an inverting input terminal of a comparator 25 whose non-inverting input terminal is grounded and is transformed to a square wave whose positive and negative levels occur repeatedly at an interval of half a period by the comparator 25. The square wave from the comparator 25 causes thyristors **28*a*, 28*b* connected in series to conduct with the leading edge of the square wave through a trigger circuit 26 and trigger transformers 27*a*, 27*b*. Accordingly, the other end of the primary coil of the transformer 24 is grounded through the thyristors 28*a*, 28*b* and a high voltage is generated in the secondary coil of the transformer 24 by the sinusoidal wave applied to the primary coil thereof. The high voltage has a wave form of the part of positive half a period shown in FIG. 2 and is applied to a wire 6*a* of the corona charger 6**.

Additionally, the first square wave from the comparator 25 is applied to a monostable multivibrator 29. The multivibrator 29 generates another second square wave having a positive level during a time period corresponding to that from the phase angle O to the firing angle $\alpha$ of the the negative half wave in addition to the positive half a period and a zero level during the rest time period, in synchronism with the leading edges of the first square wave. The second square wave causes thyristors **28*c*, 28*d* connected in series to conduct with the leading edge thereof through a trigger circuit 30 and trigger transformers 28*c*, 28*d*. As a result, the sinusoidal wave applied to the primary coil of the transformer 24 prevents the secondary coil of the transformer 24 from generating a voltage during the period from the phase angle O to the firing angle $\alpha$ of the negative half wave and to generate a negative high voltage after the time of the firing angle $\alpha$. Accordingly, the negative high voltage has a wave form of the negative half a period shown in FIG. 2 and is applied to the wire 6*a* of the corona charger 6**.

Thus, the high voltage of the wave form as shown in FIG. 2 is obtained by the power source apparatus shown in FIG. 3 to provide the secondary corona charging in the electrophotographic process of the invention.

It will be understood that the firing angle $\alpha$ can be established to a desired value by adjusting the pulse width of the square wave which is generated from the multivibrator 29.

It is to be noted that as a frequency for the power source apparatus, a frequency of the commercial power source, 50 or 60 Hz, can be practically used, and when desired to increase the speed of charging and/or exposure process, a higher frequency may be used.

Figure 4:
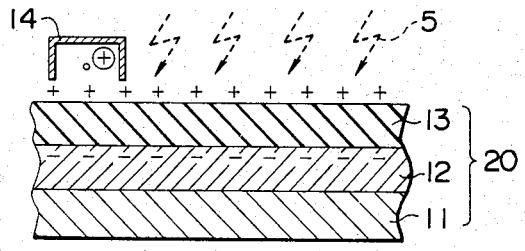
FIGS. 4 (I) to (III) are process charts showing respective sequential steps in an electrophotographic process of another embodiment according to the invention.
Figure 4:
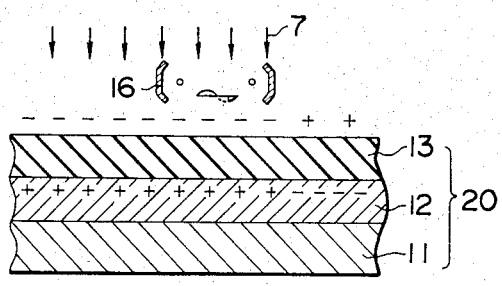
Figure 4:
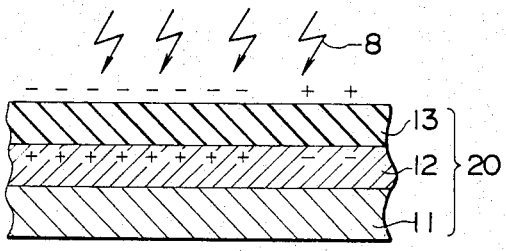

FIGS. 4 (I) to (III) show an electrophotographic process of another embodiment according to the invention in which a photosensitive member 20 is of the n-type. The photosensitive member 20 of the n-type has a basic construction in which a photoconductive layer 12 of the n-type and a transparent insulator layer 13 are sequentially laminated on the surface of a conductive supporter 11. The conductive supporter 11, photoconductive layer 12 and insulator layer 13 are formed of material similar to those of the corresponding parts in the photosensitive member 10 shown in FIGS. 1 (I) to (III).

In a first step of the electrophotographic process of the embodiment, as shown in FIG. 4 (I), a positive high level d.c. voltage is applied to a corona charger 14 to uniformly and positively charge the surface of the insulator layer 13. It is to be noted that the primary charging may be more effectively performed in combination with a uniform irradiation of light 5 in a manner similar to the process shown in FIG. 1 (I).

In a second step, as shown in FIG. 4 (II), a corona discharging is performed applying an a.c. voltage whose negative half wave is controlled in phase as shown in FIG. 2 to a corona charger 16 simultaneously with an exposure of light image 7. Thereby, a surface potential of the photosensitive member 20 at the bright area of the light image is prevented from becoming negative largely and is controlled to a zero volt or its neighborhood.

In a third step, as shown in FIG. 4 (III), a uniform irradiation of light 8 is applied from the surface side of the insulator layer 13 to form an electrostatic latent image whose bright area is negative or zero and whose dark area is positive potential.

It is possible that with the process in the embodiment shown in FIGS. 4 (I) to (III) in a manner similar to the process of the embodiment shown in FIGS. 1 (I) to (III), the resulting polarities in both processes are different from each other, and the potential at the bright area is a zero volt or its neighborhood and whose polarity is reverse to the primary charge. Accordingly, it is possible to form an electrostatic latent image with a high contrast and less possibility of causing a photographic fog.

An experimental example to which the electrophotographic process of the invention is applied will be described together with their numeral values as follows.

A photoconductive layer 2 was formed by sequentially applying a charge transport layer which is formed by vacuum evaporation of selenium Se and a charge generating layer which is formed by vacuum evaporation of selenium Se and tellurium Te on the surface of conductive supporter 1 of nickel Ni. Additionally, the photosensitive member 10 was provided which is formed of the transparent insulator layer 3 by gaseous phase evaporation of paraxylylene on the photoconductive layer 2. First, the photosensitive member 10 was provided with charge of −2,000 V by means of a Scorotron charger 4 as a primary charge under the surroundings of temperature 25° C. and humidity 60%. Subsequently, an a.c. voltage of A+=A−=6 kV, D+/D−=18/10 and frequency 50 Hz was applied to the corona charger 6 from a high voltage a.c. source apparatus as shown in FIG. 3 during the imagewise exposure and the secondary charge was applied by the corona discharging. Then the photosensitive member 10 was uniformly exposed. As a result, an electrostatic latent image having a potential at the dark area of −430 V, a potential at the bright area of +40 V and a contrast voltage 570 V was obtained. The result of providing a magnetic brush development of the latent image with a positive toner was that a good picture image of less photographic fog was obtained.

What is claimed is:

1. An electrophotographic process employing an electrophotographic member of a basic construction in which a photoconductive layer and a transparent insulator layer are sequentially laminated on the surface of a conductive supporter so that said photoconductive layer is between the transparent insulator layer and the conductive supporter, comprising the steps of:

providing a uniform primary charge upon the exposed surface of said transparent insulator layer of said photosensitive member and having a polarity which is the same as the polarity of the charging source;

providing a uniform charge having an opposite polarity along the surface at the interface between the insulator layer and the photoconductive layer;

performing a secondary charging during an imagewise exposure by applying an a.c. voltage a firing angle of which during the negative half wave is controlled in phase to be within a phase angle corresponding to a lower voltage than the firing potential so that the positive discharge period may be longer than the negative one during each period; and forming an electrostatic latent image on the surface of said transparent insulator layer by applying a uniform exposure.

2. An electrophotographic process employing an electrophotographic photosensitive member comprised of a conductive support, and a photoconductive layer and a transparent insulator layer sequentially applied to said support so that said photoconductive layer is between the transparent insulator layer and the conductor support, said process comprising the steps of:

uniformly charging the exposed surface of said transparent insulator layer with a charge whose polarity is the same as the source used for charging whereby a uniform charge of the opposite polarity is developed at the interface between the insulator layer and the photoconductive layer;

charging the exposed surface of said insulator layer concurrently with an image-wise exposure thereof, said charging being applied in an alternating polarity fashion in accordance with an a.c. voltage comprised of alternately occurring positive and negative half waves, wherein the time duration of one of said positive and negative half waves is reduced as compared with the remaining alternating half waves, so that the charging period of the half waves reduced in time duration is shorter than the charging period of the remaining half waves in order to increase the number of corona ions of positive polarity; and thereafter exposing said insulator surface to uniform radiation, thereby forming an electrostatic latent image on the surface of said transparent insulator layer.

3. The process of claim 1 wherein the photoconductive layer is formed of a P-type material and a step of uniformly charging the exposed surface of said transparent insulator layer includes irradiating the photosensitive member to produce a uniform negative charge upon the exposed surface of the insulator layer.

4. The method of claim 3 wherein the phase angle during negative half waves of the a.c. voltage is smaller than the phase angle during positive half waves whereby the discharge positive corona ions irradiating the photosensitive member during the secondary charging operation are greater in number than the discharge negative corona ions.

5. The process of claim 1 wherein the photoconductive layer is formed of a N-type material and a step of uniformly charging the exposed surface of said transparent insulator layer includes irradiating the photosensitive member to produce a uniform positive charge upon the exposed surface of the insulator layer.

6. The method of claim 5 wherein the phase angle during negative half waves of the a.c. voltage is smaller than the phase angle during positive half waves whereby the discharge positive corona ions irradiating the photosensitive member during the secondary charging operation are greater in number than the discharge negative corona ions.

* * * * *